United States Patent [19]

Ruf et al.

[11] Patent Number: 4,566,505

[45] Date of Patent: Jan. 28, 1986

[54] PACKAGING MACHINE

[75] Inventors: Walter Ruf, Sandy; Robert G. Kelley, South Jordan, both of Utah

[73] Assignee: St. Regis Corporation, New York, N.Y.

[21] Appl. No.: 509,766

[22] Filed: Jun. 30, 1983

[51] Int. Cl.[4] ..... B65B 3/04

[52] U.S. Cl. ..... 141/83; 141/114; 141/317; 53/570; 177/168; 177/187; 177/189

[58] Field of Search ..... 141/83, 67, 68, 114, 141/313–317, 37–66, 1–12; 177/168, 187, 189; 53/570

[56] References Cited

U.S. PATENT DOCUMENTS

| | | | |
|---|---|---|---|
| 2,296,163 | 9/1942 | Hartman | 141/68 |
| 2,964,070 | 12/1960 | Linhardt | 141/68 |
| 3,072,208 | 1/1963 | Titchenal et al. | 141/68 |
| 3,189,061 | 6/1965 | Stockel et al. | 141/67 |
| 3,193,030 | 7/1965 | Meier | 177/168 |
| 3,258,041 | 6/1966 | Lau | 141/67 |
| 3,265,098 | 8/1966 | O'Neal et al. | 141/5 |
| 3,269,428 | 8/1966 | Stockel et al. | 141/10 |
| 3,285,295 | 11/1966 | Titchenal et al. | 141/10 |
| 3,307,596 | 3/1967 | Stockel et al. | 141/10 |
| 3,323,559 | 6/1967 | Sturges | 141/10 |
| 3,716,082 | 2/1973 | Green | 141/68 |
| 3,831,643 | 8/1974 | Lau | 141/68 |

*Primary Examiner*—Houston S. Bell, Jr.

*Attorney, Agent, or Firm*—Fitzpatrick, Cella, Harper & Scinto

[57] ABSTRACT

A packaging machine useful for packaging fluidized dry, divided, solid material into containers such as valve bags is provided with an isolator section for isolating forces generated in the flow path of the material from a filling and weighing section. The flow path includes a filling spout that extends into the container through a valve formed therein and is sealed in the valve by an inflatable sleeve on the filling spout, the sleeve being so constructed that only that portion that enters the valve is permitted to expand.

13 Claims, 8 Drawing Figures

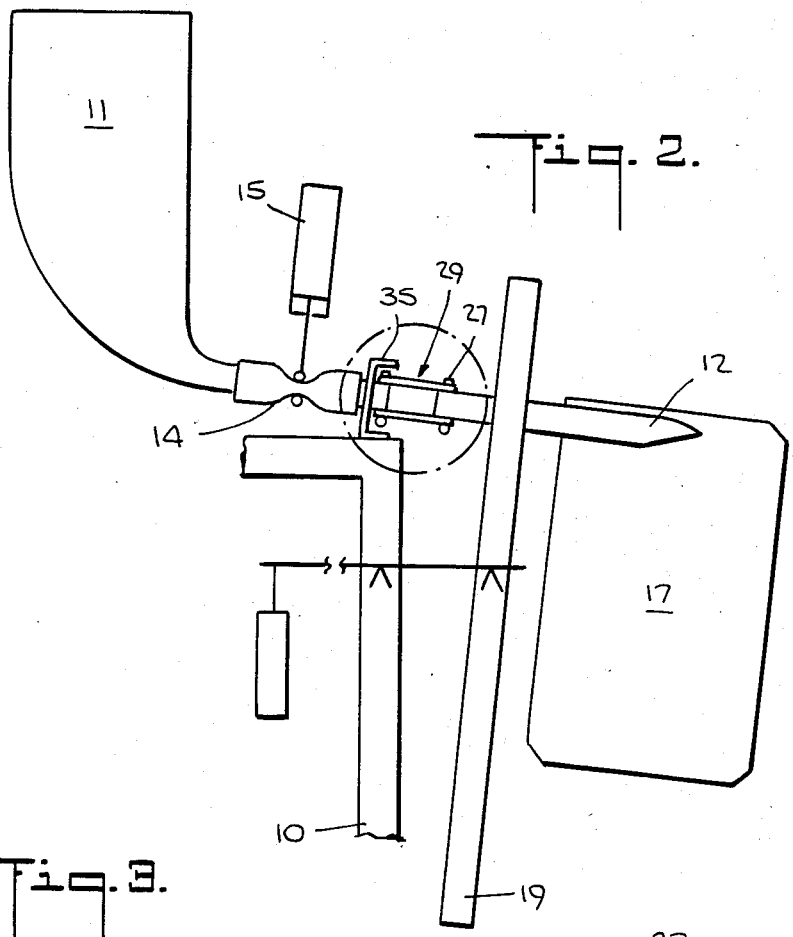
Fig. 2.
Fig. 3.
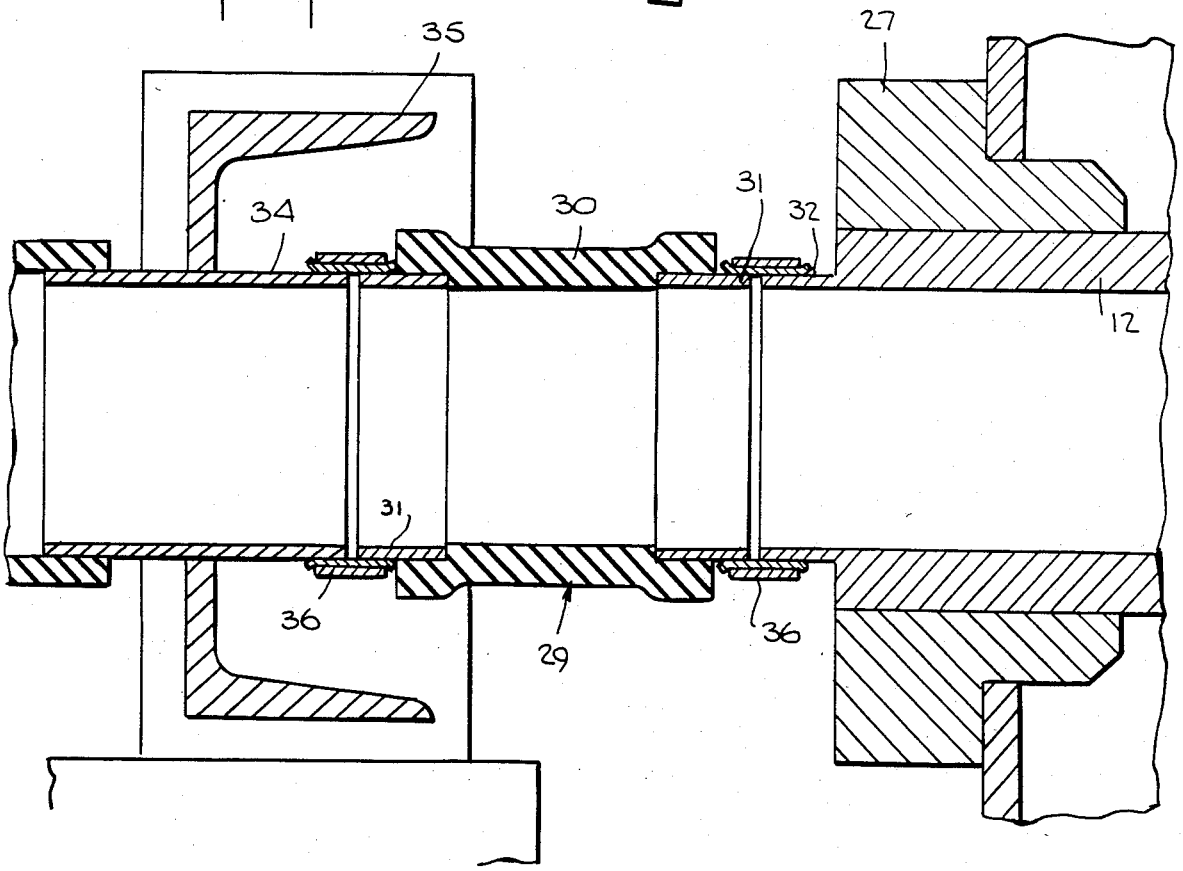

PACKAGING MACHINE

BACKGROUND OF THE INVENTION

1. Field of the Invention

This invention relates to packaging machines, and more particularly to such machines as are useful for packaging fluidized dry, divided, solid material into containers such as paper bags, for example.

2. Description of the Prior Art

Constructions of the class described are well known to those skilled in the art, and are exemplified in U.S. Pat. No. 3,261,379 which discloses apparatus including a bin for fluidizing the material to be packaged and a tubular element or conduit for conducting such fluidized material to a filling spout which may constitute the discharge end of the conduit and upon which a bag may be secured to receive a charge of the material. The bag may be weighed and the flow of material cut-off when a predetermined weight is reached, cut-off being effected by pinching a flexible tube forming a portion of the conduit through which the fluidized material moves from the bin to the filling spout.

Attention is also invited to U.S. Pat. Nos. 2,866,484 and 2,955,796 which are concerned with bag filling apparatus and disclose means for effecting a seal between the filling spout and the bag when the spout extends into the valve of a bag thus to minimize the escape of dust from the bag during filling. Such sealing is effected by providing an expansible sleeve around the filling spout, the sleeve being pressurized internally to expand during filling, and relaxed by relieving the pressure upon completion of filling to permit easy removal of the bag.

While the machines and apparatus disclosed in the above mentioned patents have achieved a degree of commercial success, nevertheless, due at least in part to the fact that forces generated by the cut-off device had not been isolated from the weighing section of the device, which section supports the filling spout, it had been impossible to achieve a desired degree of uniformity of weights of filled bags and to checkweigh bags after filling without these external forces influencing the checkweigh readings. To remedy this difficulty, it has been proposed to attempt to isolate the filling spout and weighing mechanism from the rest of the machine by forming part of the flow path between the cut-off mechanism and the filling spout of a length of flexible tubing. This was done simply by clamping one end of a length of rubber tubing to the filling tube and the other end to the adjacent end of the tube or conduit forming the material flow path downstream of the cut-off device. We have found this arrangement to be unsatisfactory because, some unbalanced forces remained adversely to affect the filling and checkweighing results. This unbalance was due to flexure in the cut-off device and in the rubber isolation tube due to pressure variations therein and to mechanically induced flexure in the cut-off device to stop the flow of material to a bag. We also noted that, regardless of how tightly the clamps were set or how large the clamps were, relatively light external forces caused the rubber tubing to shift relative to the conduit thus further aggravating the unbalanced forces acting through the filling spout on the weighing section of the machine and causing non-uniform filled bag weights.

Additionally, when the filling spout and expansible sleeve were inserted into the bag valve and the sleeve inflated to cause it to expand, if the sleeve did not fully enter the valve, as is the case where a pasted valve bag is used, that external portion of the sleeve frequently caused the bag to tear at the valve or caused damage to the sleeve when the sleeve was expanded.

SUMMARY OF THE INVENTION

We have conceived and contribute by the present invention improvements in machines of the class described by which we are able to overcome the foregoing difficulties and disadvantages, and by which we are able to achieve greater filling accuracy and bag integrity.

In essence, our invention resides in an arrangement by which we are able to eliminate the possibility of shifting of the flexible tubing, constituting the isolation tube, by providing improved means for securing the same between the cut-off mechanism and the filling spout. We have also found that while the aforesaid arrangement permits improved results, some imbalance of forces still remained in the system due to the effects of pressure changes on the isolation tube itself. Thus, we also contribute means for overcoming this disadvantage.

More specifically, we propose to imbed bands or rings of metal or other rigid materials to an inner surface at the ends of the flexible isolation tube, the rings extending outwardly of the tube ends, and then clamping one ring to the filling spout and the other ring to the adjacent end of the conduit upstream of the isolation tube. We have found that with this arrangement, the isolation tube can be positively fixed and cannot be shifted from its fixed position under forces considered normal in the machine environment.

Additionally, the tubular element upstream of the isolation tube, and to which it is clamped, is made to constitute part of an adjustable bracket. To this end, that element is connected at its upstream end to the cut-off tube and is fixed to a member which is in turn mounted to the machine frame for adjustment about a given axis whereby the isolation tube may be adjusted to equalize its effect on scale readings under pressurized and unpressurized conditions. That is to say, with the machine empty of material to be filled, the flow path is pressurized and scale readings taken. The system is then depressurized and readings taken. If the readings differ, the bracket is adjusted and the process repeated until a condition, which we shall call the null condition, is reached at which the readings under pressurized and depressurized conditions are equal, indicating that during filling, under pressure, and following cut-off, the isolation elements will have no effect on the weighing mechanism. The isolation bracket is locked in that position and the scale position at null is set to zero.

Another feature of the present invention resides in an improvement in the construction of the expansible sleeve surrounding the filling spout for use with pasted valve bags. As mentioned, inflation of this sleeve to seal the spout to the bag valve interior has often caused the bag to tear or has caused damage to the sleeve itself. We have eliminated this disadvantage by providing reinforcing material at a marginal portion of the upstream end of the sleeve, relative to the direction of material flow, thus to prevent that portion of the sleeve from expanding under the influence of pressure introduced into the sleeve to expand it.

This reinforcing material may take the form of a band of fabric, such as a ply of rayon, nylon or fiberglass or it may be a metallic element, and it may be molded into the upstream marginal portion of the sleeve which is not intended to expand, or it may be adhered to the inner or outer surface of that marginal portion of the sleeve.

As is known in the art, the sleeve itself may be made of rubber and may be clamped at its ends to the filling spout or, as disclosed in U.S. Pat. No. 2,866,484, the forward or downstream end of the sleeve may be formed with an annular, interior lip extending rearwardly and having an inner surface contacting the outer surface of the filling spout. An annular space is thus formed between the lip and the main body of the sleeve so that, when under pressure, the lip is forced into sealing engagement with the filling spout while the main body of the sleeve expands.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

DESCRIPTION OF THE DRAWINGS

Specific embodiments of the invention have been chosen for purposes of illustration and description, and are shown in the accompanying drawings, forming a part of the specification wherein:

FIG. 2 is a schematic elevational view illustrating in somewhat greater detail the arrangement of the isolation system;

FIGS. 3, 3A, 3B and 3C are respectively, a vertical sectional view of the portion of FIG. 2 encircled in chain lines, an elevational view of the adjustable bracket, a side view of the bracket of FIG. 3A and a plan view of the bracket of FIGS. 3A and 3B;

For a detailed explanation of packing machines of the class described and in connection with which the present invention finds application, attention is again invited to U.S. Pat. No. 3,261,379.

Figure 1:
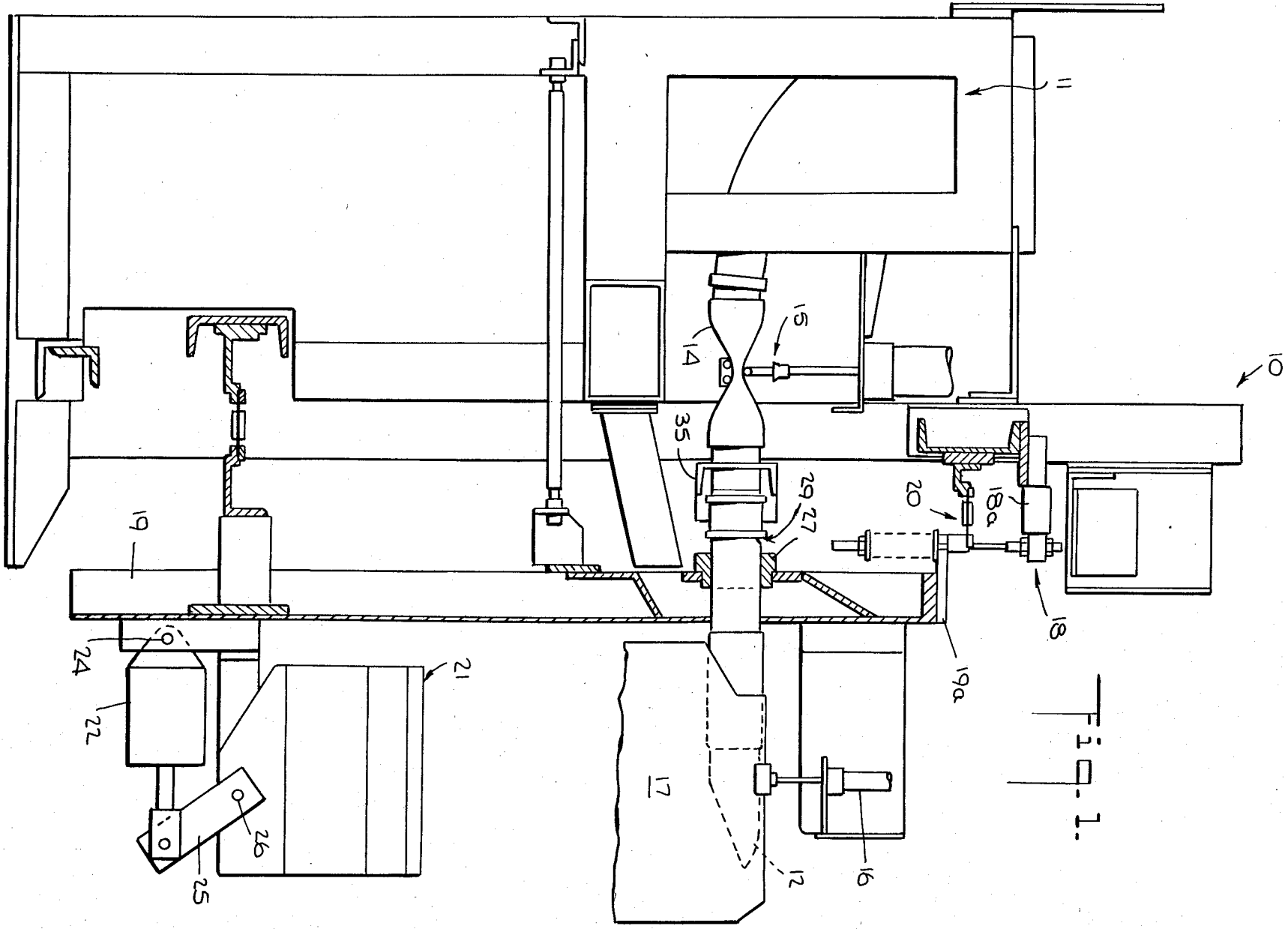
FIG. 1 is a schematic assembly view illustrating a packaging machine in connection with which the present invention is employed.

Referring to FIG. 1 herein, there is shown a frame 10 which supports a material bin 11 similar to elements designated 11 or 41 in the above-mentioned patent, and having an outlet connected to a filling spout 12 by a flexible sleeve or pinch tube 14 which may be squeezed shut to stop the flow of material through the filling spout by a cut-off device 15 of known construction.

A pneumatically operable bag clamp assembly 16 of a known type is mounted above the filling spout 12 to engage a bag 17 in the region of its valve and clamp the same against the spout to maintain the bag valve around at least a portion of the spout so that material may flow through the spout into the bag to fill the same.

A bag chair post 19 is supported from the machine frame for controlled movement by apparatus designated 20 which does not constitute a part of the present invention and need not be described here in detail. Suffice it to say that the chair post 19 supports a bag chair 21 for seating a bag during filling. Such seating arrangements are also well known in the art so that it is necessary here only to mention that the chair 21 may be tilted by operation of a pneumatic ram 22 pivoted as at 24 to the post 19 and the piston rod of which is pivoted to a crank arm 25 fixed to the bag seat at 26 thus to tilt the chair 21 to discharge a filled bag from the filling spout 12.

The filled condition of the bag is determined by its weight and, for this purpose, the chair post 19 is connected by a suitable bracket 19*a* to a load measuring device 18 which includes a load cell 18*a* conveniently mounted to the frame 10. A micro-computer, not shown, responds to the load cell and controls the pinch tube cut-off device 15 so that not only is the bag filled to a predetermined weight, but after cut-off, while the bag is still on the filling spout the micro-computer displays the finished bag weight, thus acting as a checkweigher.

As shown in FIGS. 1 and 2, the filling spout 12 is secured to the bag chair post 19 by a suitable clamp 27 and a flexible isolation device 29 interposed in the material flow path between the end of the filling spout just upstream of the clamp 27 and the pinch tube 14.

As shown in FIG. 3, the isolation device 29 includes a flexible tube 30 of rubber or the like with a metal band or ring 31 preferably vulcanized to each end thereof and extending outwardly beyond the respective end of the tube 30. The end of the filling spout 12 is formed with an annular extension 32 of the same dimension as the rings 31 so that it can be brought into abutment with the downstream ring 31. The upstream ring 31 similarly abuts a rigid tubular member 34 that extends through a channel-shaped element with which it constitutes an isolation bracket 35. Member 34 is connected at its upstream end with the downstream end of the pinch tube 14. The rings 31 are clamped by circular clamps 36 to the extension 32 on one side and to the tubular member 34 on the other side. The clamps 36 are preferably lined with felt or the like to prevent the escape of dust through the joints.

As already indicated, this arrangement allows the isolation tube to be positively fixed in position, thus to eliminate the possibility of forces caused by shifting thereof adversely to affect the weighing section of the machine.

The isolation bracket 35 may be conveniently supported to the machine frame 10 for rotary movement about an axis passing through the upstream ring 31, such as an axis perpendicular to the plane of the paper and between the ends of the upstream ring. The rotary movement may be effected through a groove and bolt arrangement, not shown, wherein grooves of a desired radius about the axis of rotation are formed in the machine frame while bolts fixed to the element 33 extend through the grooves. In this way the isolation bracket 35 may be set to its selected position about the axis of rotation and fixed there by bolting it to the frame.

According to a preferred arrangement, as shown in FIGS. 3, 3A, 3B and 3C, the isolation device 29 includes the bracket 35 through which the tube 30 passes, the bracket being loosely connected by pivot bolts 33 and tightly connected by securing bolts **35*b* to two L-shaped supports 33*a* each provided with a pair of vertically spaced elliptic slots 33*c* through each of which a bolt 33*b* (FIGS. 3B and 3C) secures the bracket to the machine frame 10**.

Figure 3A:
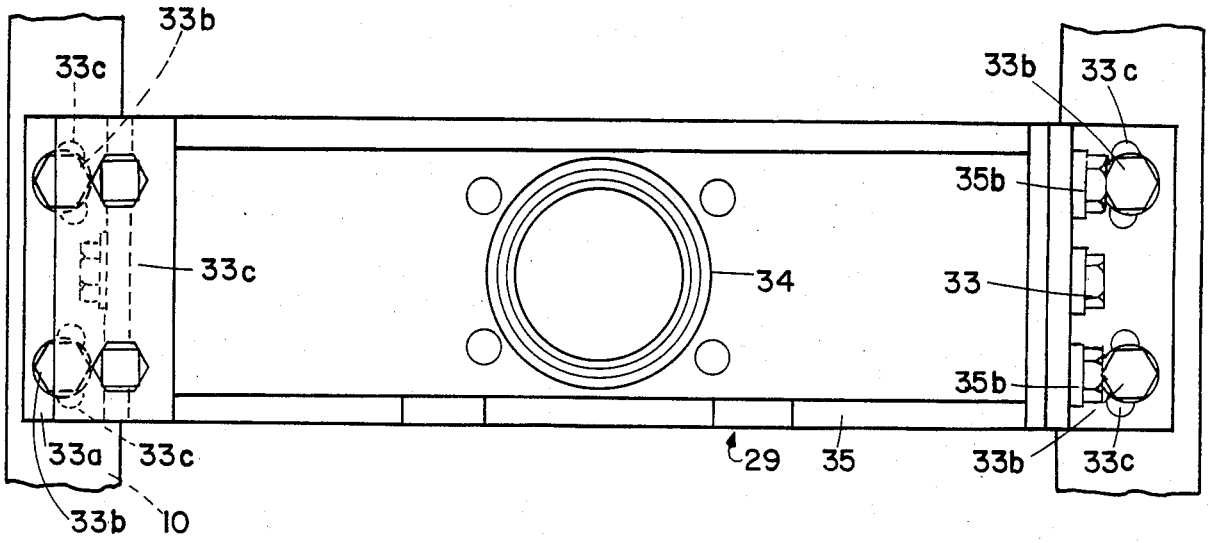
Figure 3B:
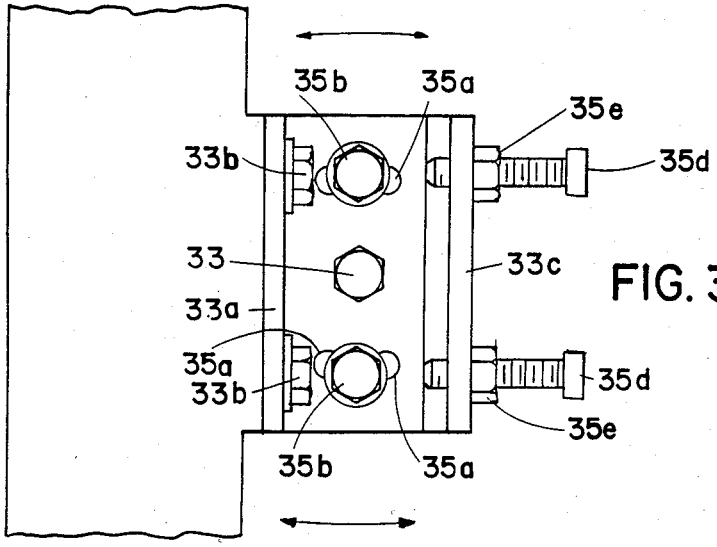

It will be appreciated that the vertical position of the bracket 35 may be adjusted relative to the frame by loosening the bolts **33*b* and raising or lowering the bracket, as indicated by the double headed arrow in FIG. 3A, within the limits provided by the slots 33*c*** and tightening the bolts when the bracket is in the selected vertical position.

Figure 3C:
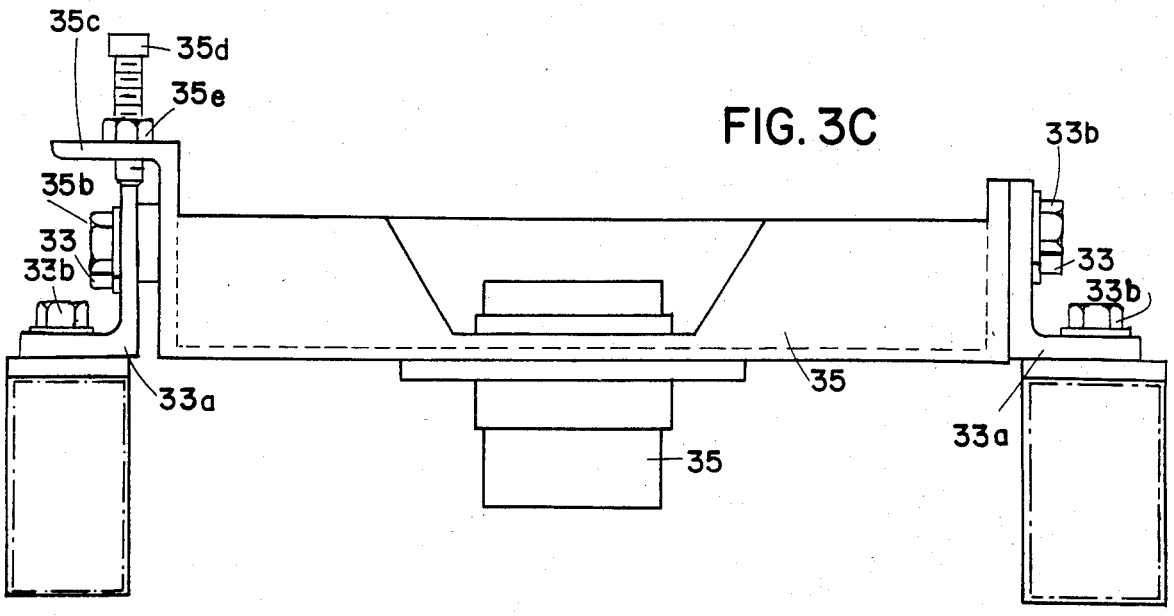

The bracket 35 is also formed with a flange **35*c* at its left side, as viewed in FIGS. 3A and 3C, overlying the end of one leg of the L-shaped support 33*a*. This flange is provided with two threaded apertures spaced an equal distance on either side of the adjacent pivot bolt 33 and a rotation adjustment bolt 35*d* carrying a lock nut 35*e*** is threaded into each aperture to bear against the end of the adjacent L-shaped support.

When the securing bolts **35*b* are loosened in curved slots 35*a*, the rotation adjustment bolts 35*d* may be independently advanced or retracted relative to the flange 35*c* to rotate the bracket 35, and thus the tube 30 about an axis passing through the upstream ring 31 and perpendicular to the plane of the paper (FIG. 3) or, with reference to FIG. 3A, about a horizontal axis through the center of the tubular member 34. When the desired position is reached, the securing bolts 35*b* are tightened to fix the bracket 35, it being noted that the pivot bolts 33 are always loosely disposed only to provide a pivot axis for the bracket 35**.

As mentioned, this arrangement permits a null condition to be established by taking scale readings with the flow path pressurized and depressurized while empty of material. If the readings differ, the isolation bracket is adjusted and the process repeated until the null condition is realized so that after cut-off in an actual filling operation, the isolated elements have no effect on the weighing mechanism. The bracket is locked in the null position.

Figure 4:
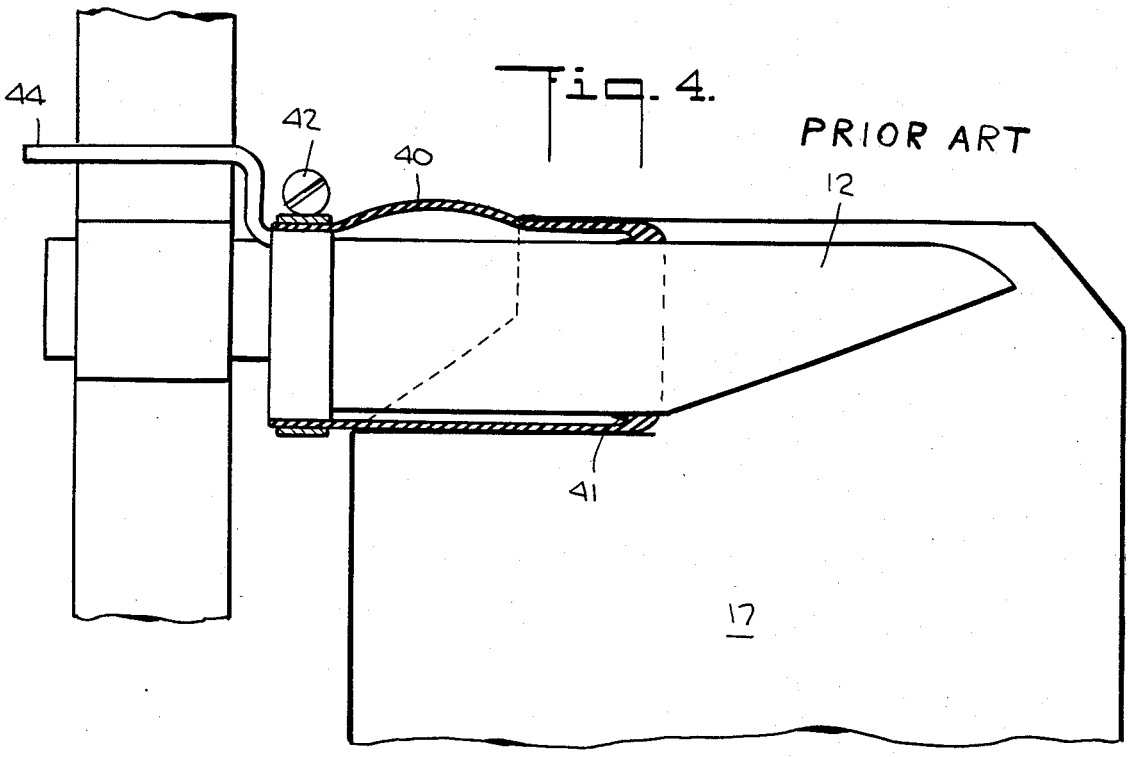
Fig. 4. PRIOR ART
FIG. 4 is a partial elevational view illustrating, in cross-section, a conventional inflatable sleeve in expanded condition and extending partially into a bag valve.

Referring now to FIG. 4, there is shown a filling spout 12 inserted into the valve opening of a bag 17 to fill the same. An inflatable, rubber sleeve 40 surrounds a portion of the spout 12 and is sealed thereto at its forward or downstream end by an internal reverse lip 41, while the upstream end of the sleeve is clamped to the spout by a clamp 42. A pressure line 44 delivers air under pressure to the space between the spout and the sleeve much as in FIG. 4 of U.S. Pat. No. 2,866,484.

As will be appreciated, when the sleeve is inflated and expands to seal against the bag valve, that portion of the sleeve exterior of the valve exerts a force on the edge of the valve that frequently causes the paper forming the valve to tear in the downstream direction. Repeated cycling of pressure in the sleeve has also caused damage to the sleeve itself in the vicinity of that portion of the sleeve at the valve entrance.

Figure 5:
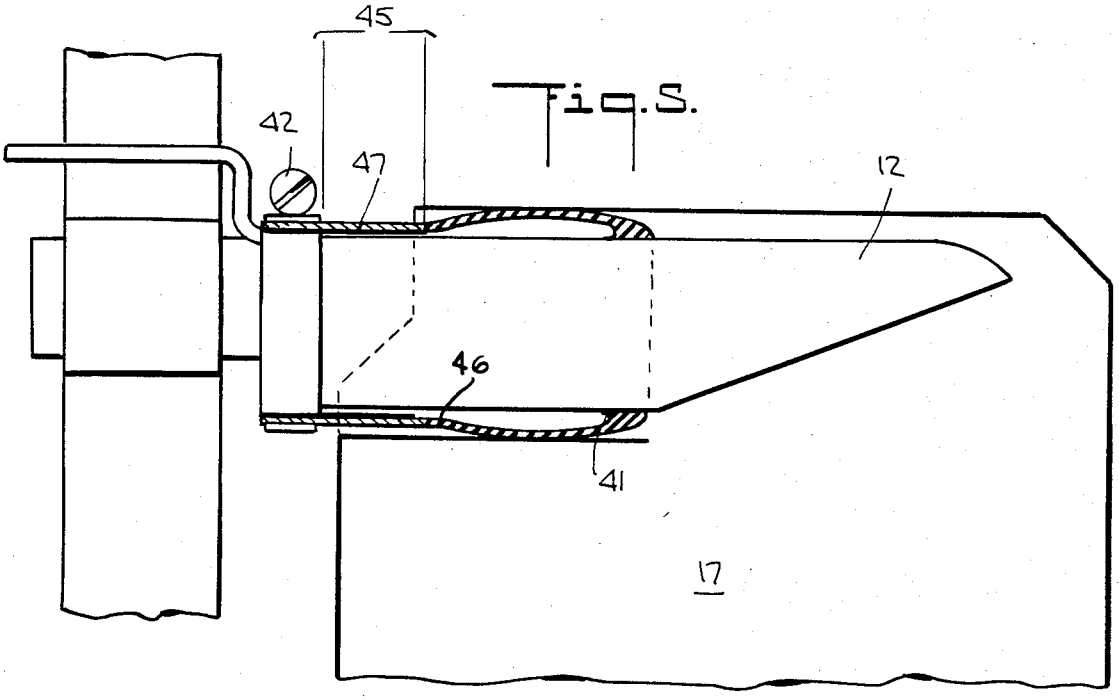
FIG. 5 is a view similar to FIG. 4 but illustrating an inflatable sleeve, according to the present invention, in expanded condition.

According to the present invention and as illustrated in FIG. 5, the upstream marginal portion 45 of the sleeve 40, that is, the portion that extends outwardly of the bag valve, is provided with a band of reinforcing material 47 to prevent that marginal portion from expanding when air under pressure is delivered to the space between the spout 12 and that portion 46 of the sleeve 40. If desired the reinforced marginal portion of the sleeve may include an annular portion of the sleeve extending just slightly into the bag valve, it being intended that the sleeve not be allowed substantial expansion at the region thereof at the bag entrance when the bag is in filling position. This of course eliminates the application of tearing forces being applied to the upstream edge of the valve and permits a tighter seal because higher sealing pressures can be used without bag or sleeve damage.

The reinforcing material may be any material suitable for the purpose, but we prefer to employ a band formed of a ply of rayon, nylon or fiberglass or metallic screening, a single ply of nylon being most preferred. The band may be bonded to the interior surface of the sleeve or molded into the desired part of the sleeve.

From the foregoing description, it will be seen that we contribute improvements in machines of the class described by which we are able to realize more accurate and uniform filled bag weights, to checkweigh the bags before removal from the machine and to prevent damage to the valve of pasted bag valves or to the filling spout sealing sleeves.

We believe that the construction and operation of our novel concept as here described will now be understood and that the advantages thereof will be fully appreciated by those persons skilled in the art.

We claim:

1. A packaging machine comprising in combination:

a bin for containing material to be packaged and having material discharge means including a dispensing outlet, conduit means defining a material flow path and a tubular filling spout adapted for introduction into a container to be filled and having a portion adapted to receive said spout;

weighing means for supporting a bag in material receiving position relative to said filling spout;

cut-off means associated with said discharge means and operative when said weighing means records a predetermined gross bag weight to close said discharge means;

adjustable means for isolating forces generated by said cut-off means from said weighing means when said cut-off means are operated to close said discharge means;

an inflatable, tubular sleeve surrounding a portion of said spout and being arranged so that, upon introduction of said spout into said bag, a portion of said sleeve is also introduced into said bag;

means for introducing fluid under pressure into said sleeve to expand the same and provide a seal between said spout and that portion of the bag surrounding said spout, and to relieve said pressure to deflate said sleeve to permit said spout to be disengaged from the bag; and reinforcing means at a marginal portion of the upstream end of said sleeve relative to the direction of material flow, thus to prevent that portion of said sleeve from expanding under the influence of pressure introduced into said sleeve.

2. A packaging apparatus comprising, in combination a bin for containing material to be packaged and being provided with material discharge means including a dispensing outlet, conduit means defining a material flow path and a filling spout;

weighing means for supporting a bag in material receiving position relative to said discharge means;

cut-off means associated with said discharge means and operative when said weighing means records a predetermined bag weight to close said discharge means; and means for isolating forces generated by said cut-off means from said weighing means including a flexible tube constituting a portion of said conduit means and provided with rigid extensions integrally connected to each end thereof, and means clamping said extensions to adjacent portions of said conduit.

3. A packaging apparatus according to claim 1, wherein said conduit means further include a tubular member extending from said bin to said filling spout and said isolating means are positioned in said conduit means between said cut-off means and said filling spout.

4. A packaging apparatus according to claim 2 or 3, wherein said isolating means are adjustable.

5. A packaging apparatus comprising:

a bin for containing material to be packaged and being provided with pressurized material discharge means including a dispensing outlet, conduit means defining a material flow path and a filling spout;

weighing means for supporting a bag in material receiving position relative to said discharge means;

cut-off means associated with said discharge means and operative when said weighing means records a predetermined bag weight to close said discharge means; and means for isolating forces generated by said cut-off means from said weighing means when said cut-off means are operated to close said discharge means, said isolating means being positioned in said conduit means between said cut-off means and said filling spout and including a flexible member constituting a portion of said means defining a material flow path, and means for adjusting the position of said flexible member relative to said conduit means.

6. A packaging apparatus according to claim 5, wherein said adjusting means include a support member and means for adjusting said support member about an axis through said flow path to a position at which a null is established in said isolation tube between its pressurized and depressurized conditions.

7. A packaging apparatus according to claim 5, wherein said isolation means include a rigid tubular section adapted to be secured to said cut-off means and a support member integral with said tubular section and constituting therewith an isolation bracket, and means for adjusting said isolation bracket about an axis through said isolating means.

8. A packaging apparatus according to claim 7, wherein said flexible member is provided with rigid extensions integral with each end thereof and means clamping said extensions to adjacent portions of said conduit means.

9. A packaging apparatus according to claim 7, wherein said flexible member is provided with rigid extensions integral with each end thereof and means clamping one of said extensions to said tubular section and the other of said extensions to said filling spout.

10. A packaging apparatus comprising, in combination:

a bin for containing material to be packaged and having material discharge means including an elongate, rigid, tubular filling spout adapted for introduction into a container to be filled and having a portion adapted to receive said spout;

an inflatable, tubular sleeve surrounding a portion of said spout and having its longitudinal axis extending in the same direction as and in close relation to that of said spout, said sleeve being arranged relative to said spout so that, upon introduction of said spout into said container, a portion of said sleeve is also introduced into the container;

means for introducing fluid under pressure into said sleeve to expand the same and provide a seal between said spout and that portion of the container surrounding said spout, and to relieve said pressure to deflate said sleeve to permit said spout to be disengaged from the container; and means reinforcing a portion of said sleeve adjacent the region at which said sleeve enters the container thus to prevent that portion of said sleeve from expanding under the influence of pressure introduced into said sleeve.

11. A packaging apparatus according to claim 10 wherein said reinforcing means is a band of fabric molded into that portion of said sleeve that does not enter the container.

12. A packaging apparatus according to claim 10 wherein said reinforcing means is a band of fabric adhered to a surface of that portion of said sleeve adjacent the region at which said sleeve enters the container.

13. A packaging apparatus according to claim 10, 11 or 12, wherein said reinforcing means comprises a ply of fabric selected from the group consisting of rayon, nylon, fiber glass or metal.

* * * * *